US005488893A

United States Patent [19]

Lewis et al.

[11] Patent Number: 5,488,893

[45] Date of Patent: Feb. 6, 1996

[54] MUTE

[75] Inventors: Roger Lewis, Sturgis, Mich.; Susan Shockey, 203 A Remington Ct., Mishawaka, Ind. 46545

[73] Assignees: Robert Lewis, Sturgis, Mich.; Susan Shockey, Mishawaka, Ind.

[21] Appl. No.: 326,759

[22] Filed: Oct. 20, 1994

[51] Int. Cl.[6] ..... G10D 9/06

[52] U.S. Cl. ..... 84/400

[58] Field of Search ..... 84/400, 453

[56] References Cited

U.S. PATENT DOCUMENTS

| | | | |
|---|---|---|---|
| D. 71,647 | 12/1926 | Magosy | 84/400 |
| D. 71,649 | 12/1926 | Magosy | 84/400 |
| D. 234,875 | 4/1975 | Beversdorf | D17/2 |
| D. 258,215 | 2/1981 | Berg | D17/2 |
| 982,732 | 1/1911 | Lehnert | 84/400 |
| 1,033,307 | 7/1912 | Elrod | 84/400 |
| 1,445,115 | 2/1923 | Turner | 84/400 |
| 1,714,513 | 5/1929 | Magosy | 84/400 |
| 1,721,764 | 7/1929 | Berg | 84/400 |
| 2,690,092 | 9/1954 | Martin | 84/400 |
| 4,273,022 | 6/1981 | Bell | 84/400 |

*Primary Examiner*—Patrick J. Stanzione
*Attorney, Agent, or Firm*—Barnes & Thornburg

[57] ABSTRACT

The present invention is directed to a mute for use in a musical instrument. The mute is generally frusto-conical in shape, and includes a plurality of ribs integrally formed with the mute. The mute also includes a plurality of plugs which are threadably adjustable relative to the mute. Each plug is independent of one another, and may be adjusted to independent heights.

14 Claims, 1 Drawing Sheet

MUTE

BACKGROUND AND SUMMARY OF THE INVENTION

The present invention is directed to a mute for use with musical instruments.

Musical instrument mutes are well known, and are typically used with wind instruments. The mute is typically a device which is inserted into the bellmouth, or exit opening, of the instrument. The mute may be used to vary the volume, pitch, richness and other qualities of the sound emanating from the instrument.

Therefore, it is an object of the present invention to provide a mute which may affect the volume, pitch, richness and other qualities of the sound of a musical instrument.

Another object of the present invention is to provide a mute which is adjustable to fit musical instruments having bellmouths of varying sizes.

A further object of the present invention is to provide a mute which may be used with musical instruments having non-uniform bellmouth dimensions.

These and other objects are attained in the mute of the present invention. While the mute of the present invention is specifically designed for use in a tuba, it should be understood that the present invention is not limited by its dimensions, and could be used with other instruments.

The objects of the present invention are attained in a mute for a musical instrument which includes a body and a plurality of ribs extending longitudinally along substantially the entire length of the body. In the embodiments shown, the ribs and body are integrally formed.

The body includes a mechanism which allows the mute to be inserted into instruments of various sizes, and to accommodate instruments having openings of a non-uniform circumference. This mechanism includes a plug which is connected to the body. The plug includes an insert, a stem, a grip and a resilient tip. The resilient tip, typically made of a rubber or rubber-like substance, is designed to engage the inner wall of the instrument bellmouth. A plurality of plugs are placed about the periphery of the mute body. By adjusting the position of the stem within the insert, the resilient tip of each plug extends a distance from the body. As each plug is independently adjustable, the mute can be snugly inserted into instruments of non-uniform dimension. For example, the present invention is ideal for use in a tuba which may include one or more dents in the instrument bellmouth. By adjusting one or more of the plugs in the mute of the present invention, such an instrument may be accommodated.

DETAILED DESCRIPTION OF THE PREFERRED EMBODIMENTS

The mute of the present invention is designed and dimensioned for use in a tuba. However, the concept and invention of this mute are not limited by any dimension, and may be modified for use with other instruments.

Figure 1:
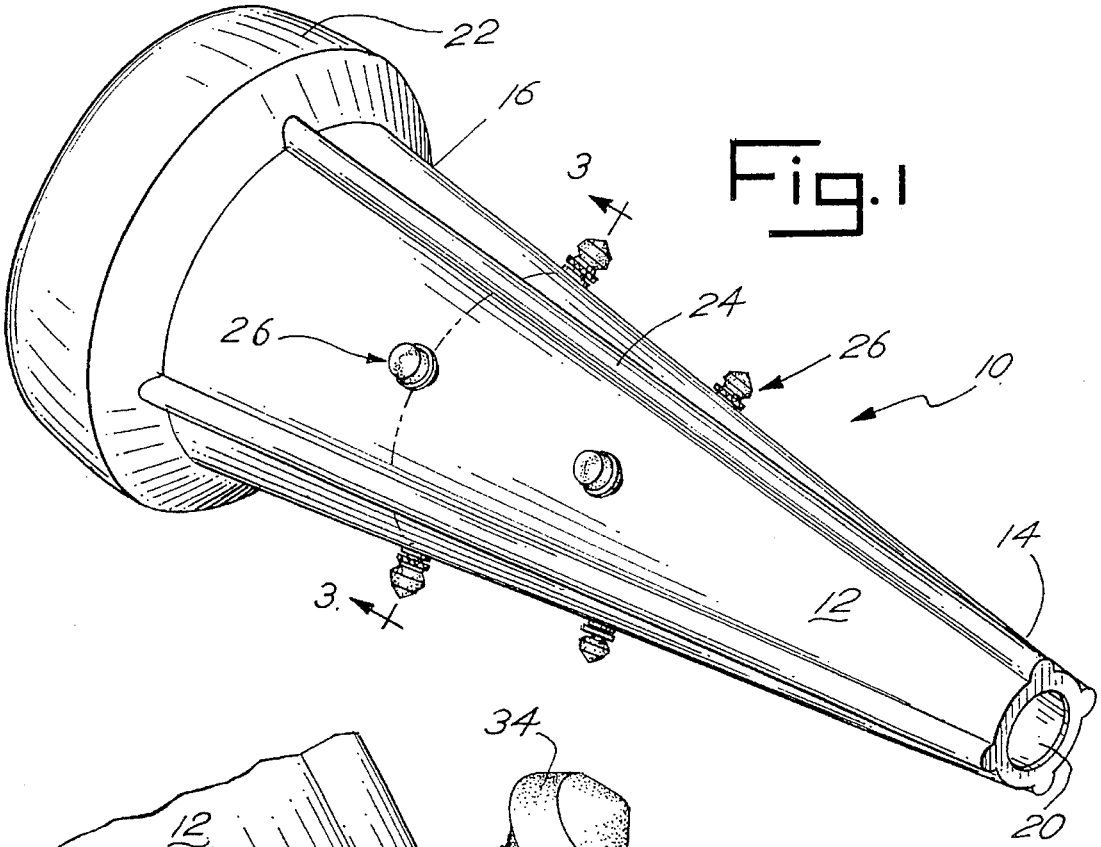
FIG. 1 is a perspective view of the mute of the present invention.
Figure 2:
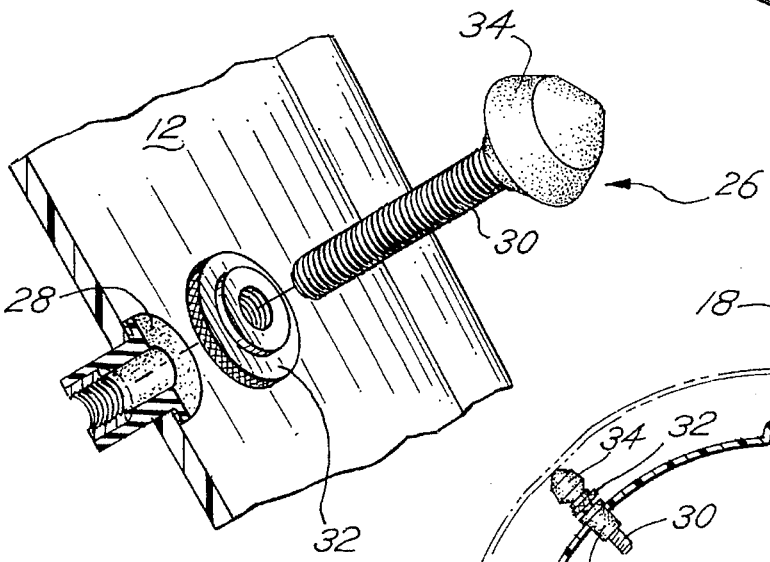
FIG. 2 is an exploded view of a portion of the mute of the present invention.

Mute 10 of the present invention is generally frustoconical in shape: that is, mute 10 includes body 12 which is generally in the shape of a cone, but has a flattened end. This can be seen in FIG. 1. Body 12 may be made of many materials. The embodiment shown is made of a rigid plastic. As shown, body 12 is substantially hollow.

Body 12 includes first end 14 and second end 16. First and 14 is the end of mute 10 which is inserted into the bellmouth of instrument 18. First end 14 has hole 20 therein. Second end 16 includes bulb 22, which is a flared ridge. For illustrative purposes only, the length of body 12 of the embodiment shown is approximately 21 inches. The diameter of first end 14 is approximately 2 inches, and the diameter of second end 16 is approximately 8 inches. As stated earlier, these dimensions may be modified.

Body 12 includes one or more ribs 24 thereon. As shown, body 12 includes four ribs 24. Ribs 24 extend longitudinally along the exterior of body 12. Ribs 24 are spaced approximately evenly about the periphery of body 12. Ribs 24, as shown, as substantially semi-circular in cross section. Ribs 24 are integrally formed with body 12, and are made of plastic.

Ribs 24 extend all the way to first end 14 of body 12, substantially flush with the end. Ribs 24 extend along body 12 until they reach bulb 22.

Body 12 also includes one or more plugs 26. Each plug 26 includes insert 28, stem 30, grip 32 and tip 34. Insert 28 has a threaded hole therein, and the insert can be press fit into a hole in body 12. An adhesive may be used to further secure insert 28 into body 12.

Tip 34 is connected to stem 30. Tip 34 is made of a resilient material, such as rubber, but is not confined to rubber. Tip 34 is designed to contact the interior surface of the bellmouth of instrument 18. Stem 30 is externally threaded. Grip 32 may be attached to stem 30, to allow for easy adjustment of stem 30 with respect to insert 28.

Stem 30 can be inserted into insert 28, and screwed to a desired location. Tip 34 can thus can independently positioned to contact the instrument bellmouth at a desired location.

The embodiment of mute 10 shown includes a plurality of plugs 26. As shown, body 12 includes two rows of plugs. Each row includes four plugs, spaced about the periphery of body 12. As shown, plugs 26 in the row nearest first end 14 of body 12 are slightly smaller in size than those in the row nearest bulb 22.

Figure 3:
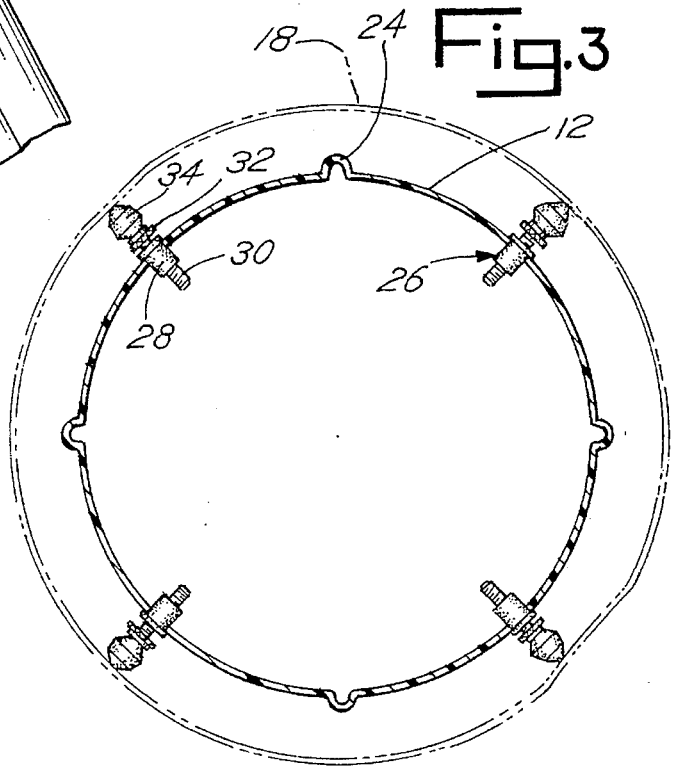
FIG. 3 is a partial cut-away view of the mute of the present invention.

One advantage of mute 10 of the present invention is that it may snugly accommodate instruments having a bellmouth that is non-circular, or non-uniform in circumference. This can be seen in FIG. 3. Each plug 26 can be adjusted independent of one another, and thus the plugs may be adjusted to accommodate dents or other irregularities in the instrument bellmouth.

What is claimed is:

1. A mute for a musical instrument comprising:

a body;

a plurality of ribs extending longitudinally along the length of the body;

wherein the body includes a first end and a second end, such that the ribs extend to the first end; and an adjustable mechanism to accommodate instruments having an opening of a non-uniform circumference.

2. The device according to claim 1 wherein the mechanism includes at least one plug which is threadably connected to the body, the plug being adjustable with respect to the body.

3. The device according to claim 1 wherein the body is substantially hollow, and the first end includes a hole therein.

4. A mute for a musical instrument comprising:

a body;

a mechanism connected to the body which allows the mute to be inserted into instruments of various sizes, the mechanism being adjustable to accommodate instruments having openings of a non-uniform circumference; and wherein the mechanism includes at least one plug.

5. The device according to claim 4 wherein said plug is threadably connected to the body, the plug being adjustable with respect to the body.

6. The device according to claim 5 wherein the plug includes a resilient tip thereon.

7. A mute for a musical instrument, comprising:

a body; and at least one plug which is threadably connected to the body, the plug being adjustable with respect to the body.

8. The device according to claim 7 wherein the plug includes a resilient tip thereon.

9. The device according to claim 8 wherein the body includes a plurality of plugs connected to the body, the plugs being spaced about the periphery of the body.

10. The device according to claim 9 wherein the plugs include resilient tips thereon.

11. The device according to claim 10 wherein the body is substantially hollow.

12. The device according to claim 11, wherein the body has a first end and a second end, the first end being the end which is inserted first into the opening in the instrument, the first end including a hole therein.

13. The device according to claim 12 wherein the body includes at least one rib thereon, the rib extending generally longitudinally along substantially the entire length of the body.

14. The device according to claim 13 wherein the ribs are formed integrally with the body.

* * * * *